United States Patent [19]

Pettit

[11] 4,010,564

[45] Mar. 8, 1977

[54] SHOTGUN WITH ADJUSTABLE VENTILATED SIGHT RIB

[75] Inventor: Charles E. Pettit, Olathe, Kans.

[73] Assignee: Simmons Gun Specialties, Inc., Olathe, Kans.

[22] Filed: Mar. 8, 1976

[21] Appl. No.: 664,562

[52] U.S. Cl. ..... 42/1 S; 33/233; 33/252

[51] Int. Cl.[2] ..... F41G 1/00

[58] Field of Search ..... 42/1 S; 33/233, 252, 33/254

[56] References Cited

UNITED STATES PATENTS

| | | | |
|---|---|---|---|
| 1,100,596 | 6/1914 | Mau | 42/1 S |
| 1,137,477 | 4/1915 | Godshalk | 42/1 S |
| 1,485,064 | 2/1924 | Berger | 42/1 S |

*Primary Examiner*—Charles T. Jordan
*Attorney, Agent, or Firm*—John A. Hamilton

[57] ABSTRACT

In combination with the barrel of a shotgun, a sighting rib extending along said barrel thereabove, and pivoted to said barrel at its rearward end on a horizontal transverse axis, and one or more short links extending angularly between the barrel and rib at their forward ends, the links being both pivoted and longitudinally slidable relative to the rib and barrel to permit changing of their angularity adjust of the angularity of the rib to the barrel, and mechanism for securing one end of each link against pivotal and sliding movement, whereby the angularity of the rib to the barrel may be fixed as desired, while leaving the opposite end of each link freely slidable to permit unequal longitudinal thermal expansion of the rib and barrel.

7 Claims, 11 Drawing Figures

SHOTGUN WITH ADJUSTABLE VENTILATED SIGHT RIB

Figures 1, 2, 3, 4, 5, 6, 7, 8, 9, 10, 11:
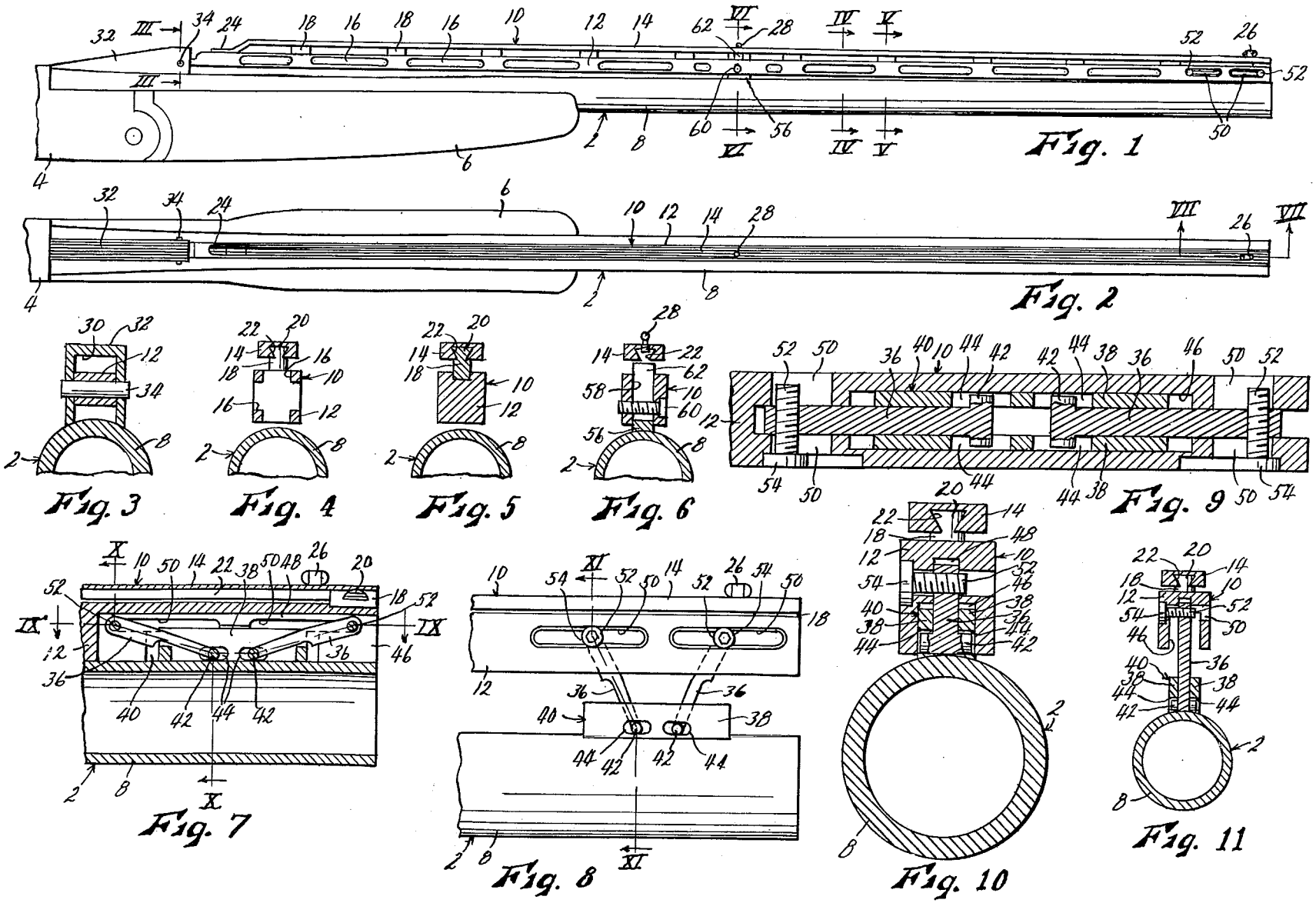

This invention relates to new and useful improvements in ventilated sight ribs for shotguns, and has as its primary object the provision of an improved structure whereby the vertical angularity of such a sight rib relative to the gun barrel may be adjusted for the purpose of adjusting the point of aim properly for relatively close or relatively distant targets.

Ventilated sight ribs, consisting of a slender bar extending along and above the gun barrel, have long been employed in connection with shotguns. In extended periods of firing, a shotgun barrel may become extremely hot, so that shimmering heat waves rise therefrom, rendering the line of sight for further shooting wavering and uncertain. The rib, providing it is kept sufficiently cool as compared to the barrel, interrupts the shimmering heat waves and thus preserves a clear, steady line of sight along its upper surface. The rib may be cooled, relative to the barrel, by providing ample space therebetween for the circulation of air. This creates the problem of unequal thermal expansion of the rib and the barrel, due to their different temperatures, so that if the rib were rigidly affixed to the barrel along its length, its lesser longitudinal expansion could actually cause an upward flexure or bowing of the barrel itself, or tend to loosen and destroy or break the connections between the rib and the barrel. On the other hand, the rib must be very securely related to the barrel, to maintain its position relative thereto despite the severe shocks delivered thereto by the firing of the gun. If means are provided for adjusting the vertical angularity of the rib relative to the barrel, as is required for accurate sighting of relatively close or distant targets, then the adjusting means must also meet the same requirements, that is, it must securely lock the rib relative to the barrel at any desired position of adjustment, while at the same time accommodating unequal thermal expansion of the rib and barrel without causing transverse bending stresses to be applied to either. The provision of an adjusting means meeting these requirements is the object of the present invention.

Generally, this object is accomplished by pivoting the rib to the barrel, at its rearward end, on a horizontal transverse axis, so that the forward end of said rib may be moved vertically relative to the barrel, and connecting the forward end portion of the rib to the barrel by one or more links lying in the vertical plane of the barrel axis. Both ends of each link may be pivoted on horizontal transverse axes, and be moved slidably relative to the barrel and rib longitudinally thereof, so that the angles of said links change as the rib is tilted relative to the barrel. Means are provided for securing one end of each link against both pivoting and sliding to secure the rib at any desired angle of tilt relative to the barrel, while leaving the other end of each link free to slide, whereby to accommodate unequal thermal expansion of the rib and barrel.

Since the span of the rib between its rearward and forward attachments is necessarily of considerable length, and since the rib is slender and hence, rather flexible, it could flex or "whip" between its points of connection when the gun is fired. Accordingly, another object is the provision of means for reinforcing the rib to prevent this occurrence. Said reinforcing means includes a reinforcing beam interposed between the rib and barrel, the rib and beam constituting a "rib assembly", and the beam being the member pivoted to the barrel and connected to the barrel by said links. The beam is of light weight but so configurated as to be strongly resistant to flexure. The rib is spaced above the beam, so as to be still further cooled, as compared to the barrel, by the presence of the beam therebetween. The rib is attached to the beam, at spaced points along its length, by means which are longitudinally slidable, whereby to accommodate unequal thermal expansion of the rib and beam. Additionally, the rib assembly may be attached intermediate its ends to the barrel by a motion "damping" device, whereby any possible vibratory flexing of the rib assembly between its principal front and rear connections is reduced.

Other objects are simplicity and economy of structure, and efficiency and dependability of operation.

With these objects in view, as well as other objects which will appear in the course of the specification, reference will be had to the accompanying drawing, wherein:

FIG. 1 is a fragmentary side elevational view of a shotgun, showing the barrel portion thereof, and an adjustable sight rib embodying the present invention mounted operatively thereon, FIG. 2 is a top plan view of the parts shown in FIG. 1, FIG. 3 is a fragmentary, enlarged sectional view taken on line III—III of FIG. 1, FIG. 4 is an enlarged, fragmentary sectional view taken on IV—IV of FIG. 1, FIG. 5 is an enlarged fragmentary sectional view taken on line V—V of FIG. 1, FIG. 6 is an enlarged, fragmentary sectional view taken on line VI—VI of FIG. 1, FIG. 7 is an enlarged, fragmentary sectional view taken on line VII—VII of FIG. 2, showing the sight rib assembly adjusted to its minimum elevation relative to the barrel, FIG. 8 is a side elevational view of the parts shown in FIG. 7, with the sight rib assembly adjusted to a higher elevation relative to the barrel, FIG. 9 is an enlarged sectional view taken on line IX—IX of FIG. 7, FIG. 10 is an enlarged sectional view taken on line X—X of FIG. 7, and FIG. 11 is a sectional view taken on line XI—XI of FIG. 8.

Like reference numerals apply to similar parts throughout the several views, and the numeral 2 applies generally to a shotgun, the portions thereof actually shown including a fragment of the receiver 4, the forearm 6, and the barrel 8, the muzzle end of said barrel being at the right as viewed in FIGS. 1 and 2. Extending along said barrel, in spaced relation thereabove and approximately parallel thereto, is a sight rib assembly indicated generally by the numeral 10. Said assembly generally comprises a slender reinforcing beam 12 and the sight rib 14 itself. Beam 12 is rectangular in cross-sectional contour, but is slotted at intervals along its length, both horizontally and vertically as best shown at 16 in FIG. 4, whereby to provide a maximum resistance to transverse flexure with a minimum of weight. Rib 14 is disposed in spaced apart relation above the beam, generally parallel thereto, and is connected thereto by a series of regularly spaced, generally vertical posts 18. Each of said posts is fixed at its lower end in beam 12, and is provided at its upper end with an upwardly divergent dovetail head 20 which is engaged very snugly but slidably in a correspondingly dovetailed groove 22 formed in the lower surface of rib 14 and extending substantially the full length of said rib. The extreme rearward end portion of the rib is angled downwardly and rigidly and permanently affixed to the top surface of the beam, as indicated at 24. The top surface of the rib may be grooved as shown, or otherwise roughened, in order to reduce the reflection or glare of sunlight therefrom. A front sight 26 of any suitable type is affixed to the rib at its forward end, and a rear sight 28 is affixed thereto intermediate its ends. The rearward end of beam 12, which projects rearwardly of rib 14, extends into a socket 30 provided therefor in a block 32 welded or otherwise affixed to the barrel at its extreme rearward end, and is pivoted in said block by means of a pivot pin 34, the axis of said pin being horizontal and transverse to the barrel, whereby the forward end of the rib assembly may be moved vertically with respect to the barrel. The top surface of block 32 may also be grooved or otherwise roughened, as indicated in FIG. 2, to reduce reflection or glare therefrom.

The forward end of rib assembly 10 is connected to the barrel by one or more (two shown) links 36 lying in a vertical plane including the barrel axis, and inclined obliquely in opposite directions within said plane. At their lower ends, said links project between the side walls 38 of a "box" 40 affixed to the barrel, said side walls extending parallel to the barrel axis, and said links engaging snugly but pivotally therebetween. At its lower end, each link is provided with a transverse pivot pin 42 extending laterally therefrom in both directions. Said pivot pin is engaged in slots 44 formed therefor in both of side walls 38, said slots engaging said pivot pins pivotally to prevent vertical movement of said pins relative to the barrel, but being elongated in a direction parallel to the barrel to permit limited sliding movement of the pivot pins in that direction. The pivot pins 42 of the two links are provided with separate sets of slots 44 in side walls 38. The forward end portion of beam 12 has a socket 46 formed in the lower surface thereof adapted to engage downwardly and slidably over box 40, as shown in FIG. 10, in order that beam 12 may be lowered sufficiently to substantially engage the top of the barrel.

Links 36 angle upwardly into a narrowed top portion 48 of socket 46, which is of a width to receive said links snugly but pivotally therein. A pair of slots 50 are formed through the beam walls adjoining narrow slot portion 48, one pair for the upper end of each of links 36. Slots 50 extend parallel to the longitudinal extent of the beam. A screw 52 is threaded transversely through the upper end of each link, extending therefrom into the corresponding set of slots 50, wherein they may slide longitudinally of said slots. Each screw is provided with an enlarged socketed head 54 engaging an external surface of the beam, whereby, when said screw is tightened, to draw the corresponding link 36 tightly against a side wall of socket section 48, and thereby to fix said link in immovable relation to beam 12.

Approximately midway between the ends of the sight rib assembly, a finger 56 is affixed at its lower end to barrel 8, and projects upward for sliding engagement in a slot 58 formed vertically therefor in beam 12, terminating at its upper end short of rib 12, even when the rib assembly is in its lowermost position relative to the barrel. A screw 60 threaded transversely through beam 12 is engaged for vertical movement in a vertical slot 62 formed therefor in the finger. By tightening screw 60, the walls of the beam may be drawn tightly against the sides of the finger, whereby to provide frictional resistance to any movement of the rib assembly in a vertical plane, relative to the barrel.

In operation, to adjust the vertical angularity of the sight rib relative to the barrel, a lower position of the forward end of the rib of course being required for accuracy in connection with more distant targets, and a higher position for less distant targets, the user first loosens screws 52 and 60, then pivots the rib assembly upwardly or downwardly about pivot pin 34 until its forward end, carrying front sight 26, is disposed at the desired elevation from the barrel. Elevation of the forward end of the rib assembly from the FIG. 7 position to the FIG. 8 position, for example, is permitted by upward and relatively inward pivoting of links 36, and by sliding of screws 52 in slots 50 of beam 12. The length of slots 44, which also permits sliding of the lower pivot pins 42 of the links parallel to the barrel axis, is so short as to be substantially negligible in connection with this adjustment. Then making certain first that pivot pins 42 are not solidly lodged in either end of their slots 44, but particularly not in the rearward ends of said slots, screws 52 are tightened securely to secure links 36 substantially immovably relative to the rib assembly 10. This locks the rib assembly firmly at a fixed vertical angularity relative to the barrel, so that the line of aim as determined by sights 26 and 28 is also fixed. Finally, screw 60 is tightened sufficiently only to cause rib beam 12 to grip finger 56 frictionally, but nevertheless yieldably.

It will be seen that while the fixing of links 36 relative to the rib assembly by the tightening of screws 52 locks the rib assembly in a fixed vertical angularity with the barrel, as desired, nevertheless the lower pivotal pins 42 of said links are still slidable in slots 44 in a direction parallel to the barrel axis. Thus when the gun is fired repeatedly and the barrel consequently becomes very hot, the barrel can expand longitudinally without imparting a bending stress to, or receiving bending stress from, the rib assembly, which of course is heated only to a lesser degree than the barrel due to their spaced apart relation and the circulation of air therebetween. Instead, as the barrel is heated and thus lengthens, slots 44 merely slide forwardly over pivot pins 42, so that no bending stress at all is transferred between the barrel and rib assembly. Perhaps just as important as the relieving of any bending stresses is the fact that the sliding connection relieves the points of attachment of the rib assembly to the barrel from pulling stresses longitudinal to the barrel. If the rib assembly were rigidly affixed to the barrel, unequal thermal expansion thereof would not only apply bending stresses to both members, tending to cause vertical bowing, but also would tend to damage or destroy the connections themselves. However, the actual relative differences of length of the barrel and rib assembly resulting from different thermal expansion is actually very slight, so that slots 44 may be quite short, as shown. Actually, one link 36 would possibly be sufficient to hold the rib assembly in its adjusted position with sufficient security. However, the use of two links, as shown, or even more, provides added security of adjustment against disturbance by possible rough handling of the gun. The opposite angling of the two links provides that the front point of support of the rib assembly remains substantially fixed relative to the barrel.

The length of the rib assembly, as compared to its cross-sectional area, is necessarily very great, with the result that it is resiliently flexible to some extent, and hence could, if supported only at its ends, flex or whip laterally in any direction, intermediate its ends due to the shock of firing the gun. The stiffening of the rib assembly by means of beam 12 partially eliminates this whipping action, and this action is further reduced or eliminated by the engagement of the beam over finger 56 of the barrel, with the engagement rendered frictional by the tightening of screw 60. Said finger positively prevents horizontal lateral movement of the rib assembly, and prevents vertical flexing by virtue of the frictional connection therebetween, which dampens any such vibratory flexure. However, this connection of finger and rib assembly should be frictionally yieldable, not rigid, since if rigid it would lock the rib assembly in a vertically flexed or bowed condition, and could prevent unequal thermal expansion of the portions of the rib and barrel behind the finger. For this reason, screw 60 should not be set extremely tightly, and finger slot 62 should be wider, longitudinally of the gun, than the diameter of the screw.

It is desirable that the sight rib 14 itself should be very slender, as shown, in order that the heating of different portions of its cross-sectional area to different temperatures will be less likely to cause bowing or flexure thereof, and for this reason the rib 14 is made a separate element from beam 12, which for reasons of strength must have a substantially greater cross-sectional area. Also, the rib is spaced apart above the beam to permit the circulation of air therebetween, so that the rib is heated to an even lesser degree than the beam, and is thus enabled to better perform its primary function of interrupting the shimmering heat waves rising from the barrel. Since the beam and rib are thus heated to different degrees, there again occurs the possibility that lateral bending stresses could be applied to either by the other. Any such stresses are prevented by the affixation of the rib to the beam at only one point, its rearward end 24, and its longitudinal sliding connection to each of the posts 18 of the beam.

While I have shown and described a specific embodiment of my invention, it will be readily apparent that many minor changes of structure and operation could be made without departing from the spirit of the invention.

What I claim as new and desire to protect by Letters Patent is:

1. In a shotgun:

a. an elongated barrel, b. an elongated sight rib assembly extending generally coextensively with and approximately parallel to said barrel, in spaced apart relation thereabove, c. means connecting the rearward end of said assembly to said barrel for pivotal movement on a horizontal transverse axis, whereby said assembly may be tilted in a vertical plane relative to said barrel, d. connecting means joining the forward end of said assembly to said barrel adjacent the muzzle end of the latter, and adjustable to vary the vertical angle of said assembly relative to said barrel, and e. securing means operable to secure said connecting means against adjustment, whereby to secure said assembly at any desired degree of vertical angularity relative to the barrel, said connecting means including a connecting member joining said assembly and said barrel, and being slidably movable relative to said barrel in a direction longitudinal to said barrel, even when said connecting means is secured against adjustment by said securing means.

2. The structure as recited in claim 1 wherein said connecting member comprises a short rigid link lying in the vertical plane of said barrel and rib assembly therebetween, and wherein said connecting means further includes:

a. means connecting the upper end of said link to said rib assembly for pivotal movement about a horizontal transverse axis and for sliding movement longitudinally of said rib assembly, and b. means connecting the lower end of said link to said barrel for pivotal movement about a horizontal transverse axis and for sliding movement longitudinally of said barrel, said securing means being operable to secure said link rigidly against any movement relative to said rib assembly.

3. The structure as recited in claim 2 wherein said connecting means includes a plurality of said links, each equipped with its own securing means.

4. The structure as recited in claim 2 wherein the upper end of said link extends into a socket formed therefor in said rib assembly, and the lower end of said link extends into a box affixed to the upper side of said barrel, said rib assembly also being socketed to engage over said box when said assembly is adjusted downwardly relative to said barrel, whereby said rib assembly may be lowered to rest substantially against said barrel.

5. The structure as recited in claim 4 wherein said means pivoting the upper end of said link in the socket formed therefor in said rib assembly constitutes a horizontal transversely extending pin extending through the upper end of said link and projecting laterally therefrom into a slot formed horizontally and transversely through said rib assembly, said slot being elongated longitudinally of said assembly.

6. The structure as recited in claim 5 wherein said pin constitutes a screw threaded in said link and extending transversely outwardly from said rib assembly through said slot and being provided at its outer end with an enlarged head based on an external surface of said rib assembly, whereby by tightening said screw said link is drawn tightly against a wall of said socket to prevent relative movement therebetween, whereby said screw serves also as said securing means.

7. The structure as recited in claim 6 with the addition of a vertical finger affixed at its lower end to said barrel intermediate the ends of said rib assembly, and projecting upwardly into a slot formed therefor in said rib assembly, and a screw threaded through said rib assembly and through a vertical slot found in said finger, whereby said screw may be tightened to draw the walls of said slot against said finger to resist yieldably any movement of said rib assembly relative to said finger, said finger slot having a width, longitudinally of the barrel, greater than the diameter of said screw.

* * * * *